US005488746A

United States Patent [19]

Hudson

[11] Patent Number: 5,488,746

[45] Date of Patent: Feb. 6, 1996

[54] POLYESTER FIBER AND FOAM CORE MATTRESS PAD

[76] Inventor: Gary C. Hudson, 4601 Sulgrave Rd., Richmond, Va. 23220

[21] Appl. No.: 323,684

[22] Filed: Oct. 18, 1994

[51] Int. Cl.[6] ..... A47G 9/00; A47C 27/00

[52] U.S. Cl. ..... 5/500; 5/468; 5/903

[58] Field of Search ..... 5/500, 499, 481, 5/468, 901, 903, 420, 502

[56] References Cited

U.S. PATENT DOCUMENTS

| | | | |
|---|---|---|---|
| 2,822,554 | 2/1958 | Wenzelberger | 5/644 |
| 3,027,573 | 4/1962 | Bell, Jr. | 5/500 |
| 4,021,871 | 5/1977 | Wortman | 5/636 |
| 4,042,986 | 8/1977 | Goodman et al. | 5/500 |
| 4,424,600 | 1/1984 | Callaway | 5/500 |
| 4,549,323 | 10/1985 | Brockmaus | 5/500 |
| 4,955,095 | 9/1990 | Gerrick | 5/470 |
| 4,961,238 | 10/1990 | Limb et al. | 5/500 |
| 5,010,616 | 4/1991 | Ackley | 5/481 |

FOREIGN PATENT DOCUMENTS

| | | | |
|---|---|---|---|
| 1310373 | 3/1973 | United Kingdom | 5/468 |
| 2134383 | 2/1983 | United Kingdom | 5/644 |

*Primary Examiner*—Alexander Grosz
*Attorney, Agent, or Firm*—Kenway & Crowley

[57] ABSTRACT

A mattress cover in which a convoluted sheet of foam is removably enclosed in a pocket or pouch composed of two layers, at least one of which is quilted to enclose quantities of fiber batting. A zippered closure joins the two layers and may be opened to remove the layer of foam and permit effective laundering of the outer layers.

2 Claims, 2 Drawing Sheets

POLYESTER FIBER AND FOAM CORE MATTRESS PAD

BACKGROUND OF THE INVENTION

The typical mattress has a tufted surface with shallow indentations. To provide greater comfort and support for the body, and to protect the mattress itself, a pad is often placed between the mattress and the sheets. Such pads are traditionally composed of down, especially in feather beds, which provide great cushioning, loft and insulation, but which are excessively warm for many sleepers, and are relatively difficult to clean. Other commonly used pads are composed of cotton wadding, quilted within fabric layers. This material is easily laundered, but provides little loft or cushioning. Sheepskin, which is also used, provides cushioning, loft and insulation like down, but is often an allergen and is difficult to clean. Desirable filling material for mattress padding should be lightweight, resilient and washable. It should be soft to provide comfort, but not so delicate that it compresses completely under the weight of the reclining body. It is also helpful if the pad retains its shape and position on the mattress to allow sleeping comfort in any position.

Natural materials such as down, cotton wadding or batting, kapok and the like have been widely used in the past for mattress padding but are now being replaced by synthetic materials, such as spun polyester fiber, and Dacron. Flexible foam material, such as convoluted foam padding, in some forms referred to as "egg crate" material, has many advantages, but lacks luxuriousness and smoothness. The very popular polyester fiber filling is disadvantageous because it tends to flatten out after time in use. The use of polyurethane foam is advantageous in several respects. The contour of the foam can be shaped to conform to the body; the foam is generally nonallergenic; it is easily cleaned; and it is relatively durable.

It has become recognized, however, that air circulation between the body and the foam product is necessary for the user's comfort. Various attempts have been made to enhance circulation, and one of the most common expedients is to form the surface of the foam abutting the body into corrugations or convolutions. These may take the form of repetitive series of peaks and valleys. However, when the head or body of a user rests on such a surface, it is in direct contact with a plurality of points which tend to bend or be crushed. The body is not contacted as desired by a smooth surface, but rather by separated pressure points which may improve air circulation but which may still give rise to discomfort. Also, of course, the feeling of cushioned resilience which is normally associated with such foam products is not had.

OBJECTS AND SUMMARY OF THE INVENTION

A major object of the present invention is a mattress pad which retains and enhances the comfort derived from the use of foam products without sacrificing air circulation.

Another object of the invention is the provision of a smooth, relatively continuous surface in contact with the user rather than a surface of spaced points.

A further object of the present invention is to improve the durability of mattress padding.

A still further object of the present invention is to simplify the cleaning and maintenance of sanitation of mattress padding.

GENERAL DESCRIPTION OF THE INVENTION

These and other objects, features and advantages have been achieved by enclosing foam sheets in a "pocket" or pouch made up of two layers of material. Both layers may be made of quilted ticking, or one may be quilted and the other a planar sheet. Each quilted layer is made of two sheets, within which polyester fiber batting is quilted. The pattern of quilting may be either channel style or onion style, the former having longitudinal stitching and the latter being stitched in roughly circular patterns forming separated areas shaped roughly like onions. The polyester fiber batting is retained in position by the quilted stitching.

The two layers are joined together at three peripheral edges, the fourth edges, preferably at an end and adjacent corners of the assembly, being jointed by a zipper closure. A sheet of foam which may be convoluted is inserted in the pouch formed by the joined layers. As noted, the one layer forming the top surface of the mattress pad may be quilted and the second or lower layer may be of simple sheet material. The resulting assembled mattress pad is placed on top of a mattress and secured thereto by four elastic corner bands. In either embodiment of the invention, the quilted top member presents a smooth, comfortable and immobile surface to the user. The foam pad is removable to permit easy and effective cleaning, as well as laundering of the enclosing pocket.

These and other objects of the invention will become more apparent from a consideration of the accompanying drawing constituting a part of the specification in which like reference characters designate like parts, and in which:

DESCRIPTION OF PREFERRED EMBODIMENT

Figure 1:
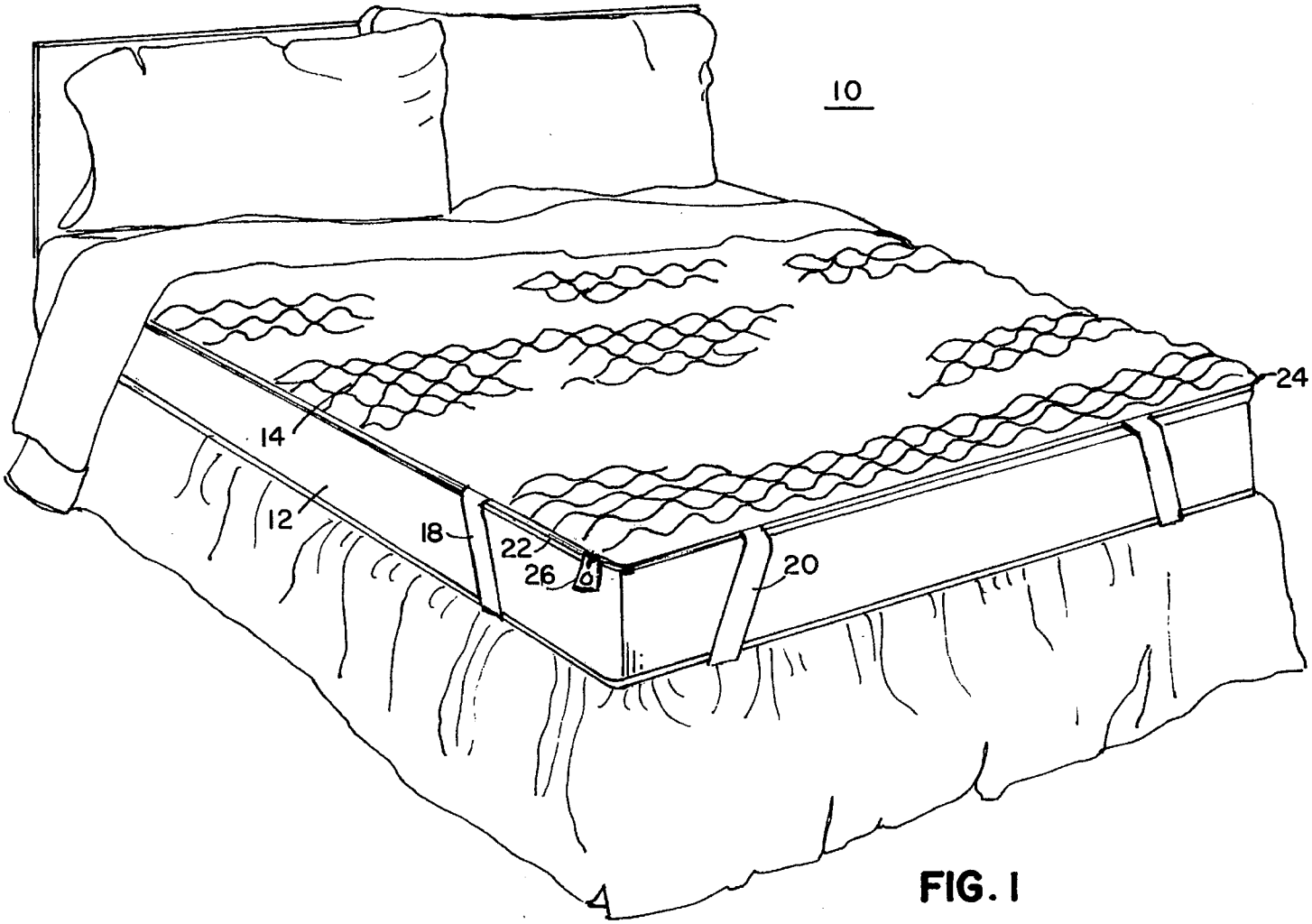
FIG. 1 is a view in perspective of a bed on which a mattress is mounted, the mattress pad of the invention being attached to the mattress.

In FIG. 1, a bed 10 is shown having a mattress 12 to which there is attached a mattress pad 14. The mattress pad may be retained in place by any conventional device such as corner straps 18 and 20. Similar corner straps, preferably made of elastic material, are provided at each of the four corners of the mattress pad.

The mattress pad is made up of two envelope layers which are described in greater detail hereinbelow. The layers are joined about their peripheral edges by permanent stitching, except for one edge and adjacent corners, as at 22 and 24, which are detachably connected by means of a zipper closure 26. The two layers with their zippered opening form a pocket or pouch in which a foam sheet is retained during use of the mattress pad. For purposes of cleaning the mattress pad, the foam sheet may be removed.

Figure 3:
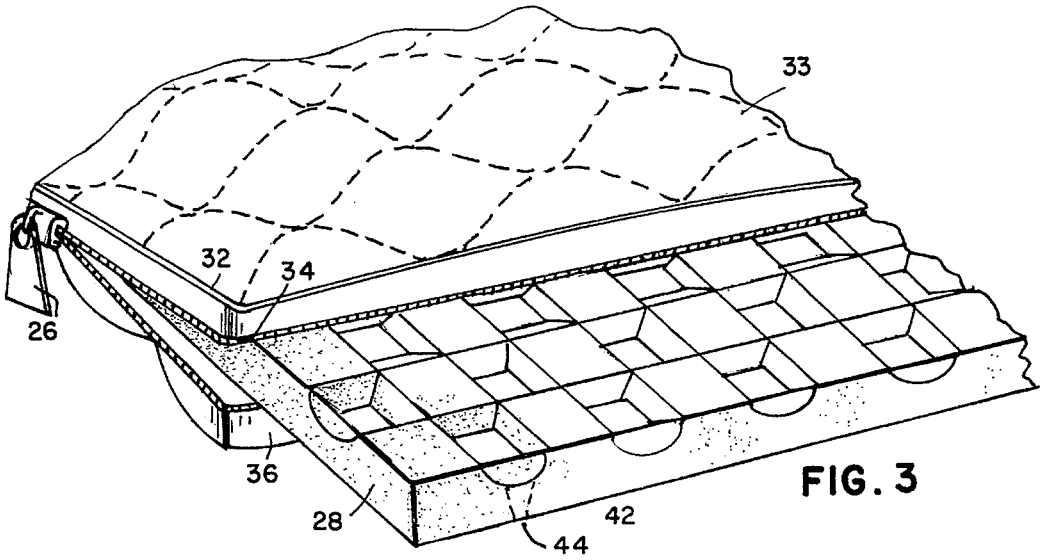
FIG. 3 is an exploded view of the mattress pad indicating the method of insertion of a foam pad in the pouch.
Figure 2:
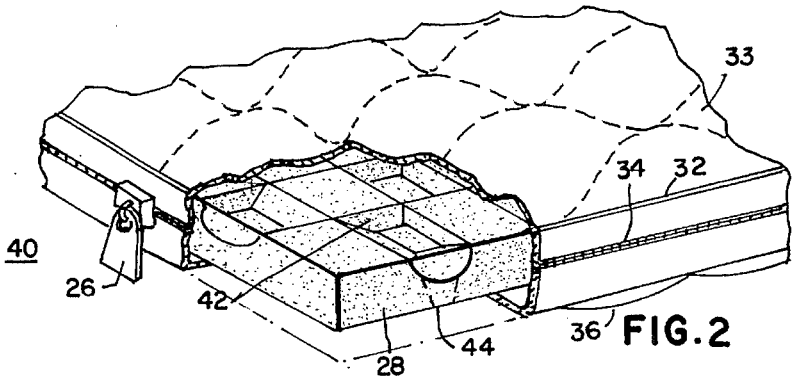
FIG. 2 is a fragmentary view in perspective with the outer members cut away to illustrate interior structure.

FIGS. 2 and 3 indicate the manner in which assembly and disassembly of the mattress pad may be achieved. Also, detail on a preferred form of foam pad 28 is found in FIGS. 2 and 3. Although the pad may be a in simple planar form, the preferred embodiment is one in which the pad is convoluted. It will be noted that the convolution shown is one in which spaced truncated conical apertures are formed. This may be done utilizing a foam convolution cutting machine of the type made and sold commercially by Edge Sweets, Inc. of Grand Rapids, Mich. as Model No. M-60 RSS & C. It includes a heavy steel frame in which an electric motor may be mounted to drive two counter-rotating rollers. The rollers have shaped intermeshing radially extending hammers mounted on their peripheries, and are held in proximity to each other on the frame. The electric motor also drives a saw blade in a path which includes a straight run in a line parallel to the axes of the rollers. The saw blade is somewhat similar to a conventional band saw blade.

Material to be processed, generally a block of polyurethane foam, is fed into the bite of the rollers, and the block is compressed to a fraction of its original thickness as it is formed about the opposing rotating hammers which deeply indent the block from both sides. As the block passes beyond the point of deep indentation but before it expands and recovers its original thickness, the saw blade severs the peaks of foam formed by and about the hammers. In the areas of greatest compression, the foam block peaks are forced so far into the openings opposite the hammers that the saw blade cuts entirely through the two blocks formed by the blade from the original single block. The foam blocks are allowed to expand to their original thickness as they emerge from the hammers. The severed peaks of course also expand with the remainder of the blocks. When the are removed, they leave deep conical openings through the blocks. U.S. Pat. No. 4,603,445 discloses apparatus and a method such as that described above, as well as a similar product obtained by practice of the method outlined.

In FIG. 2, a practical embodiment of the invention is shown to include an open end 40 into which a convoluted polyurethane foam pad 28 has been inserted. The open end 40 is provided with a zipper closure 26 which may run the full width of the end 40 and extend around the corners for several inches down each side to facilitate insertion and removal of the convoluted pad 28. To attach the entire unit to the mattress, elastic bands of which the band 18 (FIG. 1) is typical run diagonally across the four corners of the total assembly. The top layer or envelope 32 includes an upper quilted sheet 33. In this instance, a so-called onion pattern of quilting is used, the stitching forming a pattern of onion-shaped portions. The top envelope is completed by a second quilted sheet 34 which forms its lower surface. The top quilted member and the bottom quilted member are edge-stitched about their peripheries after the envelope is filled with polyester fiber, which is held in position in the envelope by the quilting. The convoluted foam pad insert 28 is approximately 1" thick and has a pattern of vertical openings of roughly conical shape, the large end of which is approximately the size of a quarter and the smaller end of which is approximately the size of a dime. These openings serve as "air ports⇆ to enhance air circulation within the assembly.

The bottom envelope member 36 is formed identically to the top envelope member 52. The quilting pattern need not be of the onion type but may be made up of longitudinal channels.

Figure 4:
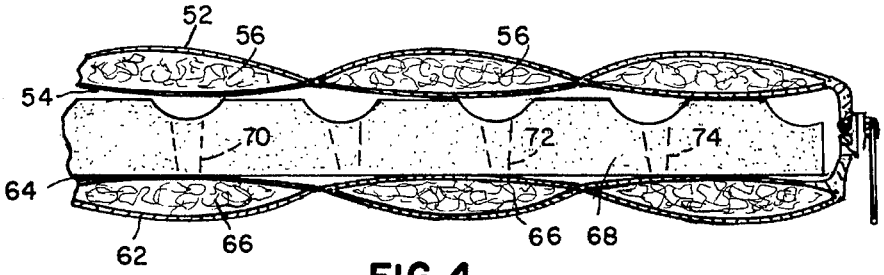
FIG. 4 is a cross-section of the mattress pad taken along the lines 4—4 of FIG. 3.

In the sectional view of FIG. 4, a top layer of another preferred embodiment of the invention includes two sheets of fabric 52 and 54 which are quilted together to contain pockets of polyester batting 56. A similar bottom quilted layer made up of basic sheets 62 and 64 quilted to contain polyester batting 66 is stitched peripherally as described above to form a pouch which contains a convoluted polyurethane layer 68. It will be seen that typical openings 70, 72 and 74 are formed through the convoluted foam pad to provide desired air circulation. As noted, however, although a quilted upper layer is preferred, the lower layer need not be quilted but may consist of only the fabric sheet 64.

Typical dimensions and configuration of the mattress pad utilized in the invention are as follows. The open end of the pouch preferably runs the full extent of the end and encompasses a length about the adjacent corners and a short distance down the sides. The elastic bands, best seen in FIG. 1, typically run diagonally across the four corners of the total assembly. The top layer member of the pouch is shown with a so-called onion pattern of quilting, the two quilted sheets being filled with polyester fiber prior to the quilting and edge stitching. The foam pad is approximately 1" thick. If convoluted, the foam pad has a pattern of conical openings, the large ends of which may be approximately 1" and the small ends about ⅝. Openings of those sizes have proven to provide suitable air circulation. In some situations where firmness is a greater consideration, the openings do not pass entirely through the foam pad, only alternating peaks and valleys being formed, and circulation is limited to a horizontal flow.

What is claimed is:

1. A mattress pad comprising a pouch having upper and lower envelope members of generally rectangular shape, said members being permanently joined along substantially the full lengths of three corresponding peripheral edges and being detachably joined at their fourth corresponding edges to form said pouch, at least one of said envelope members being quilted from two sheets of fabric between which quantities of fiber batting are retained, and a sheet of polyurethane foam convoluted to form alternating peaks and valleys and a plurality of openings through its thickness for the passage of air, said openings being generally conically formed having relatively large open ends at one surface of said sheet of polyurethane foam and relatively small open ends at the opposite surface of said sheet of polyurethane foam.

2. A mattress pad comprising a pouch having upper and lower envelope members of generally rectangular shape, at least one of said envelope members being quilted from two sheets of fabric to form pockets which quantities of fiber batting are retained, a sheet of polyurethane foam convoluted to form alternating peaks and valleys and a plurality of openings through its thickness for the passage of air, said openings being generally conically formed having relatively large open ends at one surface of said sheet of polyurethane foam and relatively small open ends at the opposite surface of said sheet of polyurethane foam, said sheet of polyurethane being removably disposed between said envelope members, a zipper closure member for joining said envelope members to form a pouch to enclose said sheet of polyurethane foam, and elastic corner bands disposed at the corners of said mattress pad to permit its attachment to a mattress.

* * * * *